US010012933B2

(12) United States Patent
Haruyama

(10) Patent No.: US 10,012,933 B2
(45) Date of Patent: Jul. 3, 2018

(54) FIXING DEVICE AND IMAGE FORMING APPARATUS

(71) Applicant: Oki Data Corporation, Tokyo (JP)

(72) Inventor: Masahiro Haruyama, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 15/348,220

(22) Filed: Nov. 10, 2016

(65) Prior Publication Data

US 2017/0176896 A1 Jun. 22, 2017

(30) Foreign Application Priority Data

Dec. 22, 2015 (JP) ..... 2015-249472

(51) Int. Cl.
*G03G 15/20* (2006.01)
*G03G 15/00* (2006.01)

(52) U.S. Cl.
CPC ..... *G03G 15/205* (2013.01); *G03G 15/5008* (2013.01)

(58) Field of Classification Search
CPC ..... G03G 15/205; G03G 15/2078; G03G 15/5008
See application file for complete search history.

(56) References Cited

U.S. PATENT DOCUMENTS

2009/0067866 A1* 3/2009 Nakamura ..... G03G 15/2064 399/67

FOREIGN PATENT DOCUMENTS

JP 2013-068906 A 4/2013

* cited by examiner

*Primary Examiner* — Hoang Ngo
(74) *Attorney, Agent, or Firm* — Rabin & Berdo, P.C.

(57) ABSTRACT

A fixing device having a fixing member heated from a heating member, and a pressing member in pressurized contact with the fixing member, formed with a contact portion either at the fixing member or at the pressing member, wherein the fixing member and the pressing member are driven only in an amount equal to or less than a width of the contact portion at every time when a certain period elapses, during a waiting state in which the fixing member and the pressing member are stopped from being driven, and in which the heating member is heating the fixing member.

12 Claims, 7 Drawing Sheets

| | WAITING TEMP. [°C] | CERTAIN PERIOD [H1] |
|---|---|---|
| MEDIUM a | 170 [°C] | 2 HOURS |
| MEDIUM b | 160 [°C] | 5 HOURS |
| MEDIUM c | 150 [°C] | 10 HOURS |

FIXING DEVICE AND IMAGE FORMING APPARATUS

CROSS REFERENCE TO RELATED APPLICATION

This application claims priority benefits under 35 U.S.C., section 119 on the basis of Japanese Patent Application No.2015-249472, the disclosure of which is incorporated herein by reference.

BACKGROUND OF THE INVENTION

1. Field of the Invention

This invention relates to a fixing device and an image forming apparatus.

2. Description of Related Art

In conventional image forming apparatuses such as printers, photocopiers, facsimiles of electrophotographic method, provided are a photosensitive drum, a charge device charging the photosensitive drum to have prescribed polarity and potential, an exposure device forming electrostatic latent images of printing data on the charged photosensitive drum, a development device visualizing the electrostatic latent images with toner as toner images, a transfer device transferring the toner images to printing paper, and a fixing device fixing toner images to the printing paper. With this mechanism, printing of the printing data is performed on the printing paper.

Such a fixing device generally used in the image forming apparatus of the electrophotographic method, has a thermal roller system in which a fixing roller and a pressing roller are rotated as in a pressurized contact state and in which the toner images formed on the printing paper are heated and melt to be fixed upon conveying the printing paper in sandwiching the paper with the fixing roller and the pressing roller. The fixing roller has inside a fixing heater or heaters made of, e.g., a halogen lamp, and is heated with the fixing heater.

With the fixing device having such a structure, however, a warming-up time of a certain period is required to heat up the fixing roller to be at a temperature necessary for fixing step from the room temperature.

A technique has been proposed in which the fixing device is subject to waiting as the fixing heater is maintained at a temperature several degrees (Celsius) lower than the prescribed temperature by controlling turning on and off the fixing heater to make shorter the warming-up time for heating up the fixing roller to be at the temperature necessary for fixing step, until a time starting printing operation of subsequent printing data after completion of fixing the printing of arbitrary printing data to the printing paper (see, e.g., Japanese Patent Application Publication No. 2013-068, 906 (A1)).

With such a fixing device, if the printing of the printing data is not performed as being in the waiting state and left as it is for a long time, a deformation or nip scar occurs in a shape extending along the outer diameter of the roller having a harder hardness on a surface of the roller having a softer hardness due to long time pressurized contact between the fixing roller and the pressing roller, so that abnormal noise may occur when the deformation goes by while the fixing roller and the pressing roller rotate, and so that rotation load may be increased.

SUMMARY OF THE INVENTION

It is an object of the invention to provide a fixing device and an image forming apparatus that can avoid occurrences of abnormal noise and increase of rotation loads due to deformation of a fixing member and a pressing member.

According to an aspect of the invention, a fixing device includes a fixing member heated from a heating member, and a pressing member in pressurized contact with the fixing member, formed with a contact portion either at the fixing member or at the pressing member, wherein the fixing member and the pressing member are driven only in an amount equal to or less than a width of the contact portion at every time when a certain period elapses, during a waiting state in which the fixing member and the pressing member are stopped from being driven and in which the heating member is heating the fixing member.

According to another aspect of the invention, an image forming apparatus includes the fixing device mentioned above, and a fixing device controller for controlling the fixing device.

These and other objects, features, aspects and advantages of the disclosed disc brake caliper will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENTS

Figure 1:
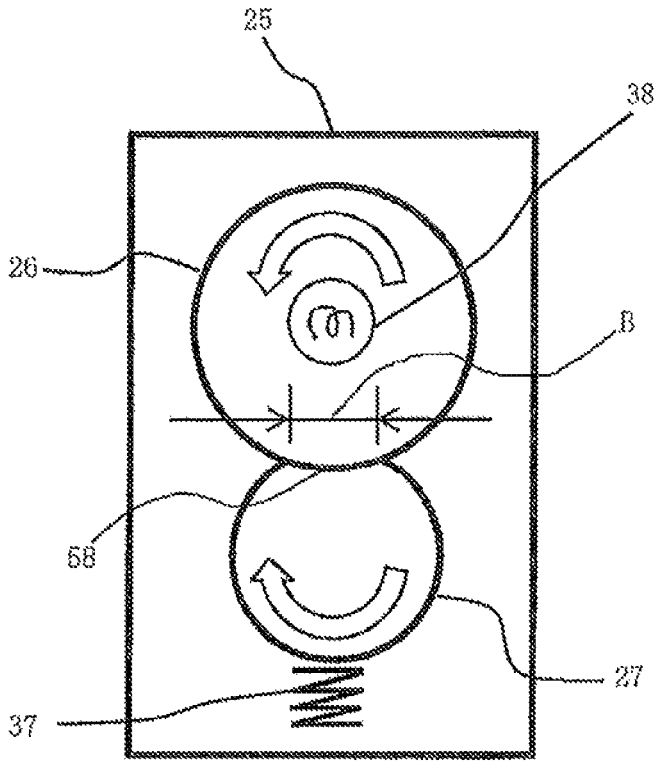
FIG. 1 is a schematic cross section showing a structure of a fixing device according to an embodiment of the invention.
Figure 2:
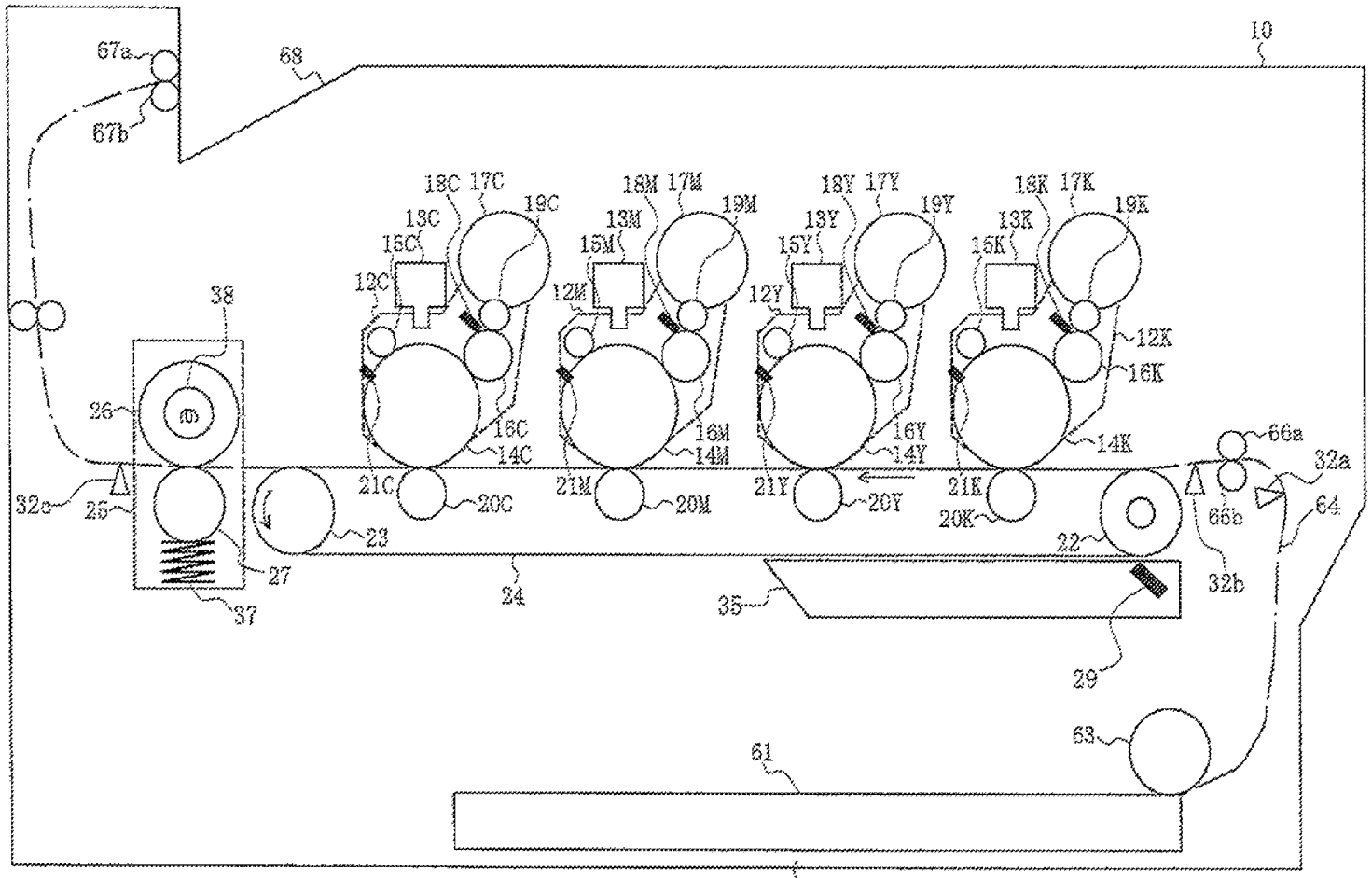
FIG. 2 is a cross section showing a structure of an image forming apparatus according to the embodiment of the invention.

Hereinafter, an embodiment according to the invention is described in detail with reference to the drawings.

An image forming apparatus 10 according to the embodiment can be, e.g., any of printer, facsimile machine, photocopier, and MFP (multi-function peripheral) having various functions, and may be formed in any type. In this embodiment, the image forming apparatus 10 is, so called, a tandem type multicolor electrophotographic type printer as an example, The image forming apparatus 10 includes image forming units 12K, 12Y, 12M, 12C corresponding to four colors of black (K), yellow (Y), magenta (M), and cyan (C) respectively disposed in a detachable manner in a tandem along a conveyance route 64 of recording paper 61 as a medium. Provided inside the image forming apparatus 10 are transfer rollers 20K, 20Y, 20M. 20C serving as transfer rollers for colors of black (K), yellow (Y), magenta (M), and cyan (C) corresponding to the image forming units 12K, 12Y, 12M, 12C, respectively, a conveyance belt 24 serving as an endless belt member conveying the recording paper 61, a drive roller 22 and a belt drive roller 23, rotating according to rotation of the conveyance belt 24, supported with springs, not shown, to maintain the tension of the conveyance belt 24 constant, a belt blade 29 made of an elastic body such as an urethane rubber for cleaning the surface of the conveyance belt 24 upon contacting the conveyance belt 24, a belt waste toner box 35 collecting toner as developer scraped off with the belt blade 29, and a heater 38 serving as a heating member such as, e.g., a halogen lamp arranged inside, and the image forming apparatus 10 is formed with a fixing device 25 including a fixing roller 26 and a fixing backup roller 27, fixing toner to the recording paper 61 in application of heat and pressure to the recording paper 61.

As shown in FIG. 1, with the fixing device 25, a nip portion 58 as a contact portion is formed at the fixing backup roller 27 serving as a pressing member, because the fixing backup roller 27 is pressed to contact the fixing roller 26 as the fixing member with a pressing contact member or members 37 made of, e.g., a spring or springs.

The nip portion 58 is made from a deformation occurring on a surface of a roller having a lower surface hardness, between the fixing roller 26 and the fixing backup roller 27, and is also a deformation in a shape extending along the outer diameter of the roller having a higher surface hardness. In the example shown in FIG. 1, the surface hardness of the fixing backup roller 27 is lower than that of the fixing roller 26, so that the nip portion 58 occurs on the surface of the fixing backup roller 27.

A surface layer of the fixing backup roller 27 is made of a material such as, silicone sponge, whereas a surface layer of the fixing roller 26 is made of a material having a core metal such as iron or aluminum on the surface of which such as a rubber layer is provided with a PFA (perfluoroalkoxy alkane) coating. The nip width B as a width of the nip portion 58 is, e.g., about 7 mm.

The image forming units 12K, 12Y, 12M, 12C have photosensitive drums 14K, 14Y, 14M, 14C as the image carriers, LED heads 13K, 13Y, 13M, 13C serving as heads for colors of black (K), yellow (Y), magenta (M), and cyan (C) and as exposing members forming electrostatic latent images for printing images in colors of black (K), yellow (Y), magenta (M), and cyan (C) on the surfaces of the photosensitive drums 14K, 14Y, 14M, 14C, charge rollers 15K, 15Y, 15M, 15C serving as charge rollers for colors of black (K), yellow (Y), magenta (M), and cyan (C) and as chargers for charging the surfaces of the photosensitive drums 14K, 14Y, 14M, 14C in supplying electricity to the surface, development rollers 16K, 16Y, 16M, 16C as development rollers for colors of black (K), yellow (Y), magenta (M), and cyan (C) for conveying toners as the developers to the surfaces of the photosensitive drums on which the electrostatic latent images are formed, toner tanks 17K, 17Y, 17M, 17C as developer containers for containing toners, development blades 18K, 18Y, 18M, 18C as layer formation members for forming toner thin layers by limiting the toners on the development rollers 16K, 16Y, 16M, 16C, toner supply sponge rollers 19K, 19Y, 19M, 19C as sponge rollers for colors of black (K), yellow (Y), magenta (M), and cyan (C) supplying toners to the development rollers 16K, 16Y, 16M, 16C, and cleaning blades 21K, 21Y, 21M, 21C removing remaining toners from the surfaces of the photosensitive drums 14K, 14Y, 14M, 14C.

It is to be noted that where the image forming units 12K, 12Y, 12M, 12C, the LED heads 13K, 13Y, 13M, 13C, the photosensitive drums 14K, 14Y, 14M, 14C, the charge rollers 15K, 15Y, 15M, 15C, the development rollers 16K, 16Y, 16M, 16C, the development blades 18K, 18Y, 18M, 18C, the toner supply rollers 19K, 19Y, 19M, 19C, the transfer rollers 20K, 20Y, 20M, 20C, and the cleaning blades 21K, 21Y, 21M, 21C are illustrated collectively, those are explained as the image forming apparatus 12, the LED head 13, the photosensitive drum 14, the charge roller 15, the development roller 16, the development blade 18, the toner supply sponge roller 19, the transfer roller 20, and the cleaning blade 21.

A feeding cassette 62 containing the recording paper 61, and a hopping roller 63 feeding separately sheet by sheet the recording paper 61 contained in an accumulated way in the feed cassette 62 are disposed. The recording paper 61 is conveyed along the conveyance route 64 by register roller pair 66*a*, 66*b* for removing skew after fed with the hopping roller 63, and is further conveyed by the conveyance belt 24 via image forming units 12K, 12Y, 12M, 12C sequentially. When the recording paper 61 passes by the fixing device 25, the toner transferred to the recording paper 61 is fixed thereto in application of heat and pressure. Finally, the recording paper 61 delivered from the fixing device 25 is conveyed along the conveyance route 64, and is delivered by delivery rollers 67*a*, 67*b* and stacked on a stacker 68. An entry sensor 32*a* detecting existence of the recording paper 61, a write sensor 32*b*, and a delivery sensor 32*c* are arranged at respective portions of the conveyance route 64 for the recording paper 61.

The image forming apparatus 10 is formed with a motor or motors rotating, e.g., rollers, rollers on the conveyance route 64 separated from one another in a distance equal to or less than the minimum interval between the pickup rollers, and a solenoid or solenoids for switching the conveyance route. The motors includes, as described below, a conveyance belt motor 52 rotating the belt drive roller 23, a fixing motor 28 driving or namely rotating the fixing roller 26 and the fixing backup roller 27, and unit motors 48K, 48Y, 48M, 48C independent from each other for rotating respective portions of the image forming units 12K, 12Y, 12M, 12C. The image forming apparatus 10 has a temperature sensor 32*d* as described below for detecting the temperature inside the apparatus, and a density sensor 32*e* as described below for measuring the density.

Figure 3:
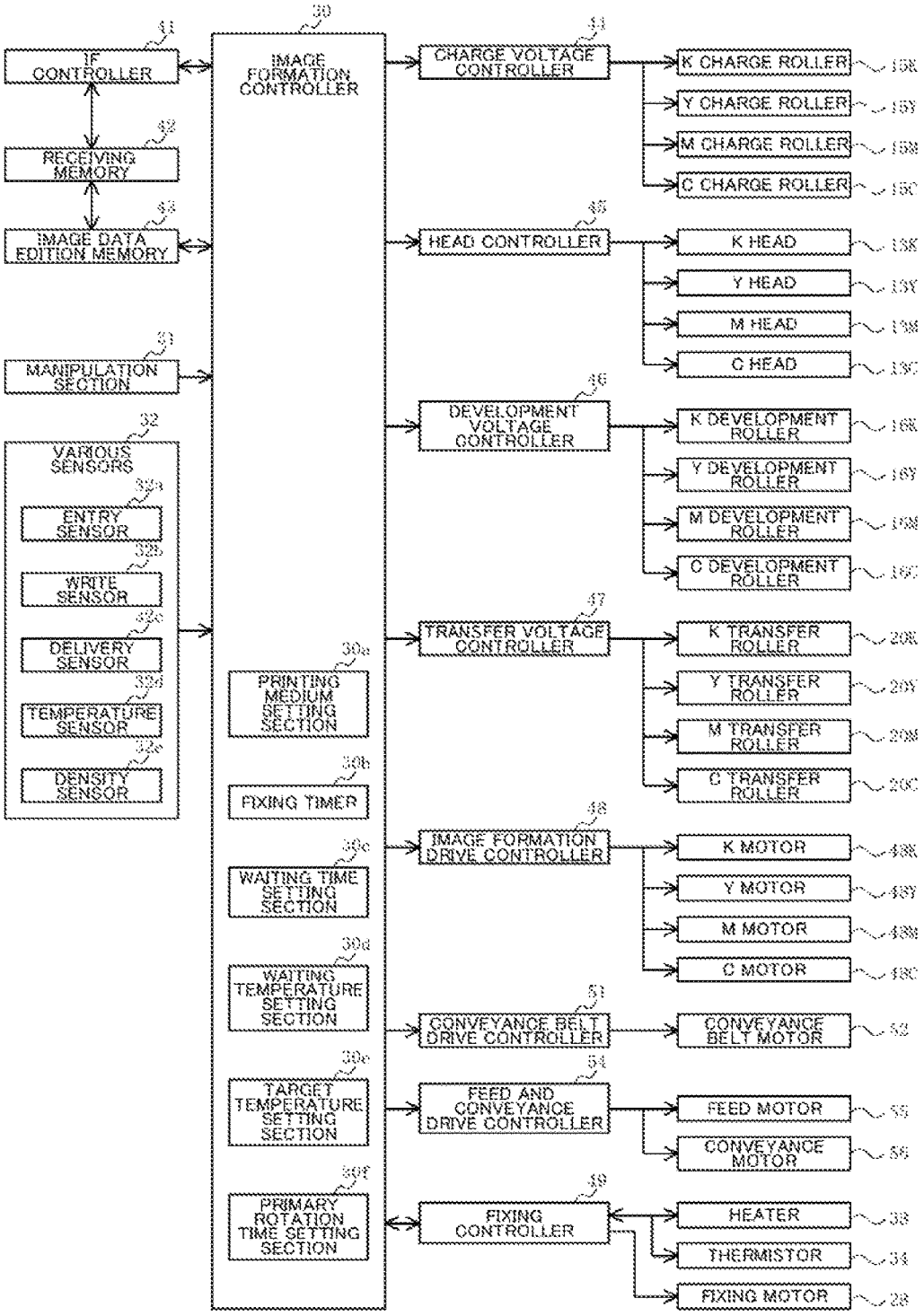
FIG. 3 is a block diagram showing a structure of a control system of the image forming apparatus according to the embodiment of the invention.

The system structure of the image forming apparatus 10 is as shown in FIG. 3. In FIG. 3, an image forming controller 30 is formed with such as, e.g., a microprocessor, a ROM or ROMs, a RAM or RAMs, input output ports, a timer, and sequentially controls the entire image forming apparatus 10 upon receiving the printing data and the control commands from the host apparatus to perform printing operation. The image forming controller 30 includes a printing medium setting section 30*a* setting the recording paper 61 as the media of various types, a fixing timer 30*b* measuring time of post-fixing, a waiting time setting section 30*c* setting a time maintaining the waiting state after fixing, a waiting temperature setting section 30*d* setting the temperature in the waiting state of the fixing device 25, a target temperature setting section 30*e* setting the temperature of the fixing device 25 at the time of printing operation, and a primary rotation time setting section 30*f* setting, in the waiting state, a period from the stop of the fixing motor 28 to the time to rotate in a prescribed amount.

An I/F controller 41 is provided for making communications with host apparatuses such as external computers, transmitting the printer information to the host apparatuses, analyzing commands inputted from the host apparatuses, and processing the data received from the host apparatuses.

A receiving memory 42 stores the data received from the host apparatuses separately for each color based on the control of the I/F controller 41.

A manipulation section 31 has LEDs indicating the status of the image forming apparatus 10, and switches providing indications from the operator to the image forming apparatus 10.

Various sensors 32 include the entry sensor 32*a*, the write sensor 32*b*, the delivery sensor 32*c*, the temperature sensor 32*d* detecting the temperature inside the apparatus, and the density sensor for measuring density. The outputs of the various sensors 32 are connected with the inputs of the image forming controller 30.

An image data edition memory 43 is provided for editing, as image data, the printing data entered from the host apparatuses via the I/F controller 41. The image data edition memory 43 receives the printing data temporarily stored in the receiving memory 42 and stores the image data edited and processed to be sent to the image forming controller 30.

A charge voltage controller 44 applies voltages respectively to the charge rollers 15K, 15Y, 15M, 15C as the charge rollers for four colors K, Y, M, C according to instructions from the image forming controller 30, and makes control to charge the surface of the photosensitive drums 14K, 14Y, 14M, 14C.

A head controller 45 operates the LED heads 13K, 13Y, 13M, 13C as the heads for four colors K, Y, M, C according to the image data stored in the image data edition memory 43, and controls to make exposure by radiating light onto the surfaces of the charged photosensitive drums 14K, 14Y, 14M, 14C.

A development voltage controller 46 applies voltages respectively to the development rollers 16K, 16Y, 16M, 16C as the development rollers for four colors K, Y, M, C according to the instructions from the image forming controller 30, and controls to apply development voltages for attaching the toners to the electrostatic latent images formed on the surfaces of the photosensitive drums 14K, 14Y, 14M, 14C.

A transfer voltage controller 47 applies voltages respectively to the transfer rollers 20K, 20Y, 20M, 20C as the transfer rollers for four colors K, Y, M, C according to the instructions from the image forming controller 30, and controls to apply transfer voltages for transferring the toner images formed on the surfaces of the photosensitive drums 14K, 14Y, 14M, 14C to the recording paper 61.

An image forming drive controller 48 controls the motors 48K, 48Y, 48M, 48C for four colors K, Y, M, C according to the instructions from the image forming controller 30, and controls rotations of the charge rollers 15K, 15Y, 15M, 15C and the development rollers 16K, 16Y, 16M, 16C.

A fixing controller 49 is provided for fixing the toner images transferred from the recording paper 61 and controls to apply a voltage to the heater 38 built in the fixing apparatus 25 according to the instructions from the image forming controller 30. The fixing controller 49 controls turning on and off of the heater 38 upon reception of the detected temperature from the thermistor 34 for measuring the temperature of the fixing device 25. The fixing controller 49 controls the fixing motor 28 to drive the fixing roller 26 and the fixing backup roller 27 when the fixing device 25 is heated up to the certain temperature. In other words, the fixing controller 49, together with the image forming controller 30, functions as a controller for controlling operation of the fixing device 25.

A conveyance belt drive controller 51 drives the conveyance belt 24 for conveying the recording paper 61, and controls the conveyance belt motor 52 driving the belt drive roller 23 rotating the conveyance belt 24 upon receiving the instructions from image forming controller 30.

A feed conveyance drive controller 54 is provided for feeding and conveying the recording paper 61 from the feed cassette 62 to the position of the conveyance belt 24, and controls the feed motor 55 and the conveyance motor 56 driving the hopping roller 63, and the register roller pair 66*a*, 66*b*, respectively upon receiving the instructions from image forming controller 30.

In operation of the image forming apparatus 10, first, a basic operation for printing the recording paper 61 is described.

The image forming controller 30 receives the control commands and printing data transmitted from the host apparatus via the I/F controller 41. Upon reception of the printing instruction from the host apparatus, the image forming controller 30 designates a prescribed conveyance speed to the feed conveyance drive controller 54, thereby rotating the hopping roller 63 as the feed roller. With this operation, the recording paper 61 stacked and contained in the feed cassette 62 is separated sheet by sheet and fed to the register roller pair 66*a*, 66*b* as the conveyance roller. The entry sensor 32*a* detects as to whether the hopping roller 63 feeds the paper in an ordinary manner, and is disposed to make the hopping roller 63 perform feeding operation again if not feeding in the ordinary manner.

The recording paper 61 fed to the register roller pair 66*a*, 66*b* is conveyed to the image forming units 12K, 12Y, 12M, 12C by the register roller pair 66*a*, 66*b*. The image forming units 12K, 12Y, 12M, 12C begin rendering the respective rollers rotate at the same time to beginning of paper feeding.

A negative voltage (about −1000 V) that the image forming controller 30 instructs the charge voltage controller 44 is supplied to the charge rollers 15K, 15Y, 15M, 15C, thereby charging the surfaces of the photosensitive drums 14K, 14Y, 14M, 14C.

The toners used for printing are supplied from the toner tanks 17K, 17Y, 17M, 17C via the toner supply sponge rollers 19K, 19Y, 19M, 19C to the development rollers 16K, 16Y, 16M, 16C. The toners attached to the surfaces of the development rollers 16K, 16Y, 16M, 16C are triboelectrified by the development blades 18K, 18Y, 18M, 18C.

The belt drive roller 23 rotates according to the rotation beginning of the photosensitive drums 14K, 14Y, 14M, 14C, thereby starting rotation of the conveyance belt 24.

If the recording paper 61 is further conveyed by the register roller pair 66*a*, 66*b*, the write sensor 32*b* detects a front end of the recording paper 61, thereby turning on each unit. The LED head 13K starts exposing at a timing of a certain period after the detection of the front end of the recording paper 61 by the write sensor 32*b*, and the electrostatic latent images are formed on the photosensitive drum 14K. Where the electrostatic latent images are developed by the development roller 16K, the toner images are formed on the photosensitive drum 14K. When the recording paper 61 reaches a portion between the photosensitive drum 14K and transfer roller 20K, the transfer roller 20K is supplied with a positive voltage (about +3000 V), so that the toner on the photosensitive drum 14K is attracted toward the recording paper 61, thereby transferring the tone images onto the recording paper 61.

Subsequently, with respect to toner images in colors other than black, or namely yellow, magenta, and cyan, exposure, development and transfer steps are performed sequentially.

Upon completion of transfer of respective color toner images to the recording paper 61, the recording paper 61 is fed to the fixing device 25. The recording paper 61 receives application of heat and pressure by passing between the fixing roller 26 and the fixing backup roller 27. With this application, the toner images are fixed to the recording paper 61. The front end of the recording paper 61 delivered from the fixing device 25 is detected by the delivery sensor 32*c* for monitoring paper jam and for detecting the medium length after fixing. The recording paper 61 is then conveyed along the conveyance route 64, and is delivered with the delivery roller pair 67*a*, 67*b* and stacked on the stacker 68. The printing operation is completed with a sequence described above.

Next, operation of the fixing device 25 having the structure described above will be explained in detail.

Figure 4:
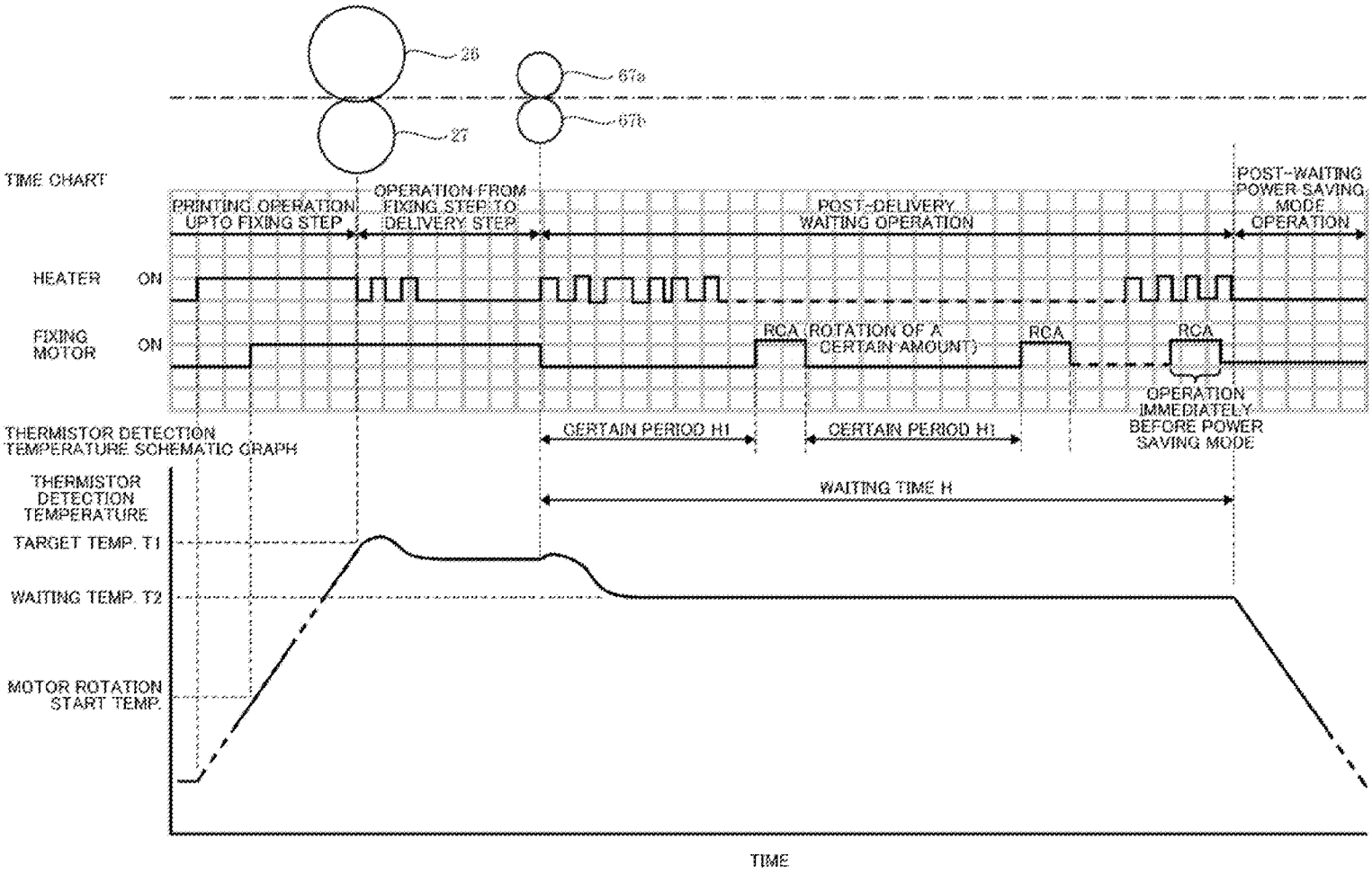
FIG. 4 is a time chart showing operation of the fixing device according to the embodiment of the invention.

FIG. 4 is a time chart showing operation of the fixing device 25 according to the embodiment of the invention.

The image forming controller 30, upon reception of printing instruction from the host apparatus, judges as to whether the heating temperature heated by the heater 38, or namely the temperature detected with the thermistor 34, is equal to or less than the target temperature T1 (e.g., 180 degrees Celsius). If the temperature is equal to or less than the target temperature T1, the heater 38 is controlled to be turned on and off so that the temperature becomes the target temperature T1.

Subsequently, the image forming controller 30 starts rotating the fixing motor 28 where the temperature detected with the thermistor 34 increases and reaches a prescribed temperature, or namely a motor rotation start temperature, e.g., 100 degrees Celsius, thereby rotating or driving the fixing roller 26 and the fixing backup roller 27. The temperature detected by the thermistor 34 until that the front end of the recording paper 61 conveyed from the image forming unit 12 disposed on an upstream side of the conveyance route 64 reaches the vicinity of the nip portion 58 between the fixing roller 26 and the fixing backup roller 27, reaches the target temperature T1. The recording paper 61 is subject to application of heat and pressure by passing the portion between the fixing roller 26 and the fixing backup roller 27. With this operation, the toner images are fixed to recording paper 61. It is to be noted that while the recording paper 61 passes the portion between the fixing roller 26 and the fixing backup roller 27, the image forming controller 30 controls turning on and off of the heater 38.

Subsequently, where the recording paper 61 is delivered to the stacker 68 by the delivery roller pair 67*a*, 67*b*, the image forming controller 30 stops the rotation of the fixing motor 28. The lapse time after stop of the fixing motor 28 is measured by the fixing time 30*b*. The image forming controller 30 also controls turning on and off of the heater 38 so that the temperature detected with the thermistor 38 becomes a waiting temperature T2, e.g., 170 degrees Celsius. More specifically, the image forming controller 30 controls turning on and off of the heater 38 so that the temperature detected with the thermistor 34 maintains the waiting temperature T2, where the lapse time measured by the fixing timer 30*b* is within a waiting time H set by the waiting time setting section 30*c*. The waiting temperature T2 is set by the waiting temperature setting section 30*d*.

If the lapse time measured by the fixing timer 30*b* passes the waiting time H, the image forming controller 30 controls the heater 38 to be turned off and makes a shift to a power saving mode as a power saving state. It is to be noted that the waiting time H can be set arbitrarily, and, for example, it can be set so that the temperature detected with the thermistor 34 maintains the waiting temperature T2 where the main power of the image forming apparatus 10 is tuned on.

Where, within the waiting time H such that the heater 38 is controlled to be turned on and off as to maintain the temperature detected with the thermistor 34 to be the waiting temperature T2, the passing time measured with the fixing timer 30*b* passes the certain period H1 such as, e.g., two hours as a certain period set by the primary rotation time setting section 30*f* without receiving any printing instruction from the host apparatus, the image forming controller 30 rotates the fixing motor 28 in a prescribed amount. Then, where the passing time measured with the fixing timer 30*b* passes the certain period H1 again without receiving any printing instruction from the host apparatus, the image forming controller 30 rotates the fixing motor 28 in the prescribed amount one more time. Subsequently, the image forming controller 30 repeats operation to rotate the fixing motor 28 in the prescribed amount at each time passing the certain period H1 where not receiving any printing instruction from the host apparatus within the certain period H1.

Figure 5:
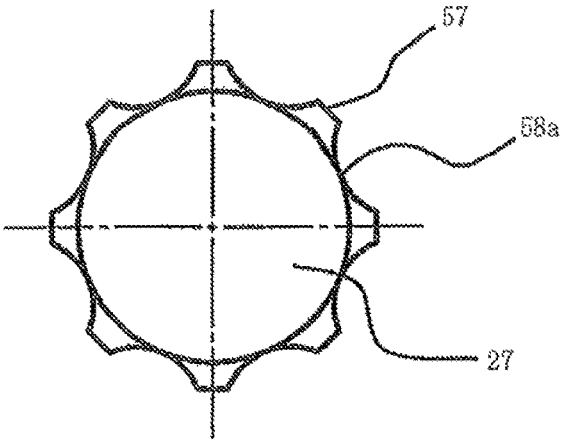
FIG. 5 is a schematic cross section showing a shape of a fixing backup roller at which some nip scar occurs according to the embodiment of the invention.
Figure 6:
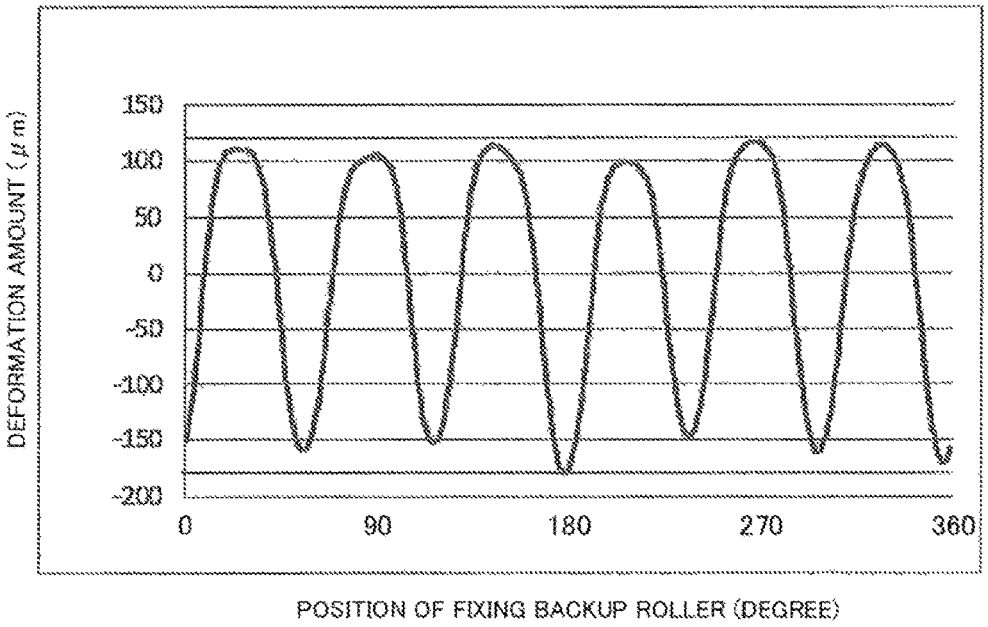
FIG. 6 is a first graph showing a relation between position of the surface of the fixing backup roller and deformation amount in the embodiment of the invention.
Figure 7:
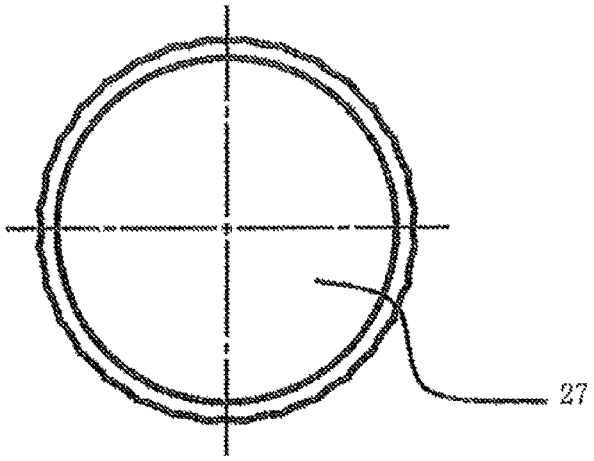
FIG. 7 is a schematic cross section showing a shape of a fixing backup roller that preventing any nip scar from occurring according to the embodiment of the invention.
Figure 8:
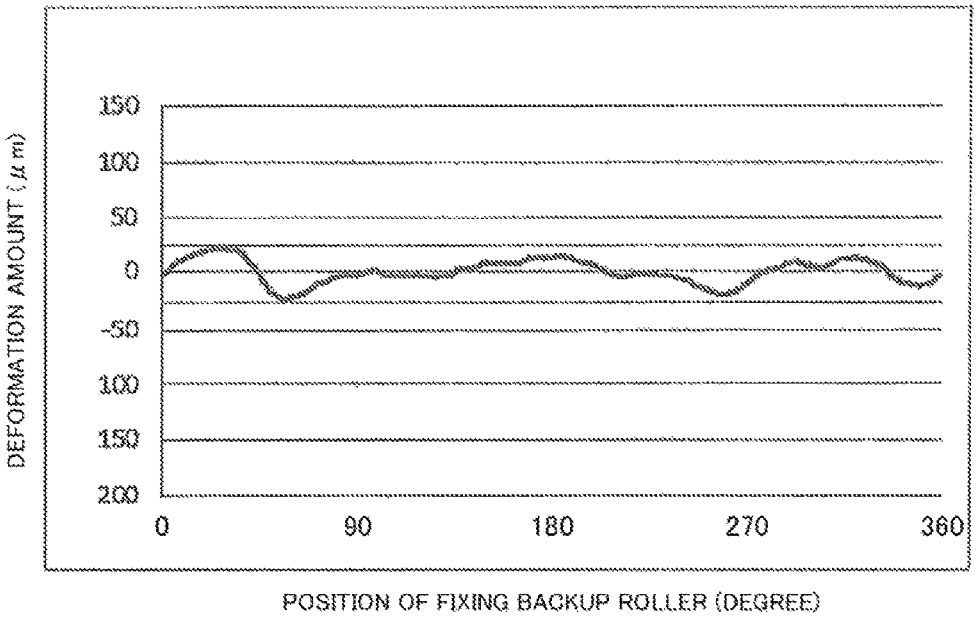
FIG. 8 is a second graph showing a relation between position of the surface of the fixing backup roller and deformation amount in the embodiment of the invention.

The prescribed amount that the fixing motor 28 rotates is described next. FIG. 5 is a schematic cross section showing a shape of a fixing backup roller at which some nip scar occurs according to the embodiment of the invention; FIG. 6 is a first graph showing a relation between position of the surface of the fixing backup roller and deformation amount in the embodiment of the invention; FIG. 7 is a schematic cross section showing a shape of a fixing backup roller that preventing any nip scar from occurring according to the embodiment of the invention; FIG. 8 is a second graph showing a relation between position of the surface of the fixing backup roller and deformation amount in the embodiment of the invention.

As described above, the fixing backup roller 27 is formed with the nip portion 58 as shown in FIG. 1. The nip width B as the width of the nip portion 58 is, e.g., 7 mm.

If the driving or moving mount in the circumferential direction of the surfaces of the fixing roller 26 and the fixing backup roller 27 driving or rotating according to the operation that the fixing motor 28 rotates in the prescribed amount at each time passing the certain period H1, is designed to be an amount more than the nip width B, the surface of the fixing backup roller 27 moves in exceeding the nip portion 58 where the fixing motor 28 is rotated in the prescribed amount. If the operation that the fixing motor 28 is rotated in the prescribed amount at each time passing the certain period H1, is repeated, the surface of the fixing backup roller 27 repetitively moves beyond the nip portion 58.

Accordingly, if the operation that the fixing motor 28 is rotated in the prescribed amount at each time passing the certain period H1, is repeated without receiving the printing instruction from the host apparatus for a long time of period, plural recesses 58*a* reflecting the shape of the nip portion 58 occur on the surface of the fixing backup roller 27 as nip scars as shown in FIG. 5. Convex portions 57 are formed between the recesses 58*a* adjacent to each other. In other words, a deformation occurs in which the recess 58*a* and the convex portion 57 alternatively appear on the surface of the fixing backup roller 27.

In this situation, the deformation amount on the surface of the fixing backup roller 27 likely changes as shown in FIG. 6. In FIG. 6, the horizontal axis indicates the position of the surface of the fixing backup roller 27 with the rotational angle, whereas the vertical axis indicates the deformation amount (micron) of the surface of the fixing backup roller 27. In the example shown in FIG. 6, it is turned out that the surface of the fixing backup roller 27 is deformed plus and minus 150 microns.

To the contrary, if the moving mount in the circumferential direction of the surfaces of the fixing roller 26 and the fixing backup roller 27 rotating according to the operation that the fixing motor 28 rotates in the prescribed amount at each time passing the certain period H1, is designed to be an amount equal to or less than the nip width B, e.g., 4 mm, the surface of the fixing backup roller 27 does not move in exceeding the nip portion 58 where the fixing motor 28 is rotated in the prescribed amount. That is, the end of the nip portion 58 of this turn is located at a position in a midway of the previous nip portion 58, where the fixing motor 28 is rotated only in the prescribed amount.

Accordingly, even where the operation that the fixing motor 28 is rotated in the prescribed amount at each time passing the certain period H1, is repeated without receiving the printing instruction from the host apparatus for a long time of period, large undulations made of such as recesses 58*a* and the convex portions 57 are not be formed on the surface of the fixing backup roller 27 as shown in FIG. 7, so that the fixing backup roller 27 can prevent nip scars from occurring on the surface of fixing backup roller 27.

The deformation amount of the surface of the fixing backup roller 27 at this situation changes as shown in FIG. 8. In FIG. 8, the horizontal axis indicates the position of the surface of the fixing backup roller 27 with the rotational angle, whereas the vertical axis indicates the deformation amount (micron) of the surface of the fixing backup roller 27. In the example shown in FIG. 8, it is turned out that the surface of the fixing backup roller 27 is deformed merely plus and minus 50 microns.

Accordingly, where the moving mount in the circumferential direction of the surfaces of the fixing roller 26 and the fixing backup roller 27 rotating according to the operation that the fixing motor 28 rotates in the prescribed amount at each time passing the certain period H1, is designed to be an amount equal to or less than the nip width B, the fixing backup roller 27 can prevent nip scars from occurring on the surface of fixing backup roller 27.

Next, various settings where the image forming apparatus 10 is in a waiting state, are described.

Figures 9, 10:
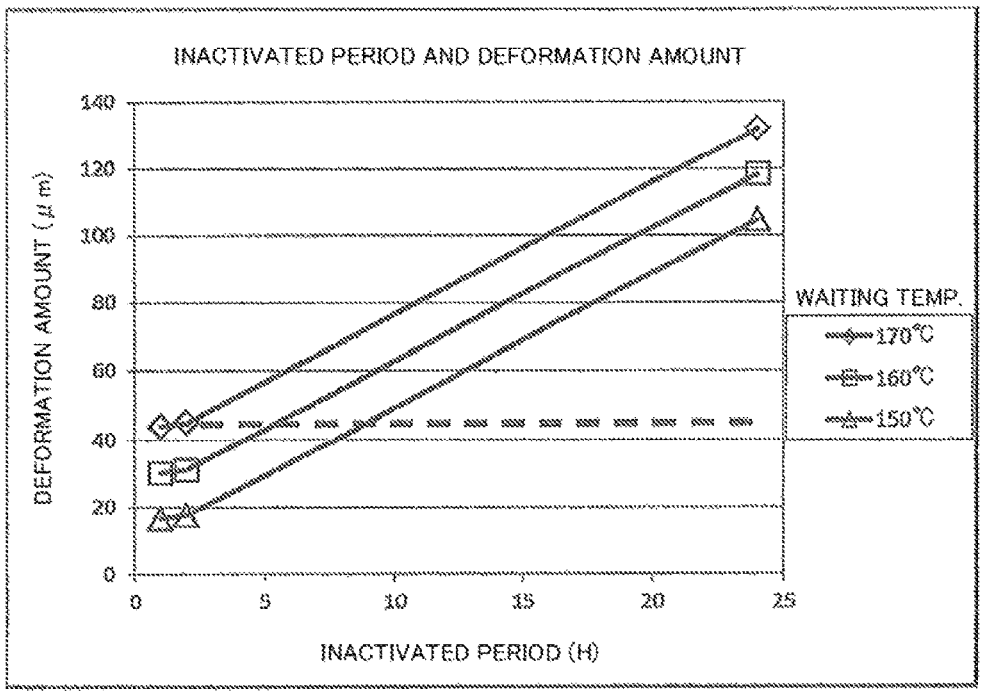
FIG. 9 is a table showing waiting temperature corresponding to kinds of the recording paper and setting examples of certain periods.
FIG. 10 is a graph showing a relation between deformation amount of the surface of the fixing backup roller and inactivated time in the embodiment of the invention.

FIG. 9 is a table showing waiting temperature corresponding to kinds of the recording paper and setting examples of certain periods; FIG. 10 is a graph showing a relation between deformation amount of the surface of the fixing backup roller and inactivated time in the embodiment of the invention.

The waiting temperature setting section 30*d* sets different temperatures as the waiting temperature T2 according to the kind of the recording paper 61 set with the printing medium setting section 30*a*. The primary rotation time setting section 30*f* sets different time as the certain period H1 according to the kind of the recording paper 61 set with the printing medium setting section 30*a*.

In this embodiment, as shown in FIG. 9, with respect to each of the recording paper 61 of three types set with the printing medium setting section 30*a*, or namely, medium a, medium b, and medium c, the waiting temperature setting section 30*d* sets waiting temperatures T2 of three types, or namely, 170 degrees Celsius, 160 degrees Celsius, and 150 degrees Celsius, and the primary rotation time setting section 30*f* sets the certain periods H1 of three types, or namely, two (2) hours, five (5) hours, and ten (10) hours. Among the three types of the recording paper 61, the medium a has the thickest thickness, and medium c has the thinnest thickness. It can be said that the waiting temperature setting section 30*d* sets the waiting temperature T2 higher as the recording paper 61 has the thicker thickness. It also can be said that the primary rotation time setting section 30*f* sets the certain periods H1 shorter as the recording paper 61 has the thicker thickness.

As shown in FIG. 10, the deformation amount of the surface of the fixing backup roller 27 becomes different according to the waiting temperature T2. In FIG. 10, the horizontal axis indicates the inactivated time left as it is in a waiting state, or namely a state not operating to rotate the fixing motor 28 only in the prescribed amount, and the vertical axis indicates the deformation amount (micron) of the surface of the fixing backup roller 27.

FIG. 10 indicates a comparison of the deformation amounts of the surface of the fixing backup roller 27 with the waiting temperature T2 of the three types; a solid line including diamond shaped dots indicates the deformation amount in the waiting state where the waiting temperature T2 is 170 degrees Celsius; a solid line including square shaped dots indicates the deformation amount in the waiting state where the waiting temperature T2 is 160 degrees Celsius; a solid line including triangle shaped dots indicates the deformation amount in the waiting state where the waiting temperature T2 is 150 degrees Celsius. The broken line indicates the deformation amount where the fixing motor 28 is operated to rotate at each of the certain period H1 with the setting corresponding to the medium a, or namely the setting in which the waiting temperature T2 is 170 degrees Celsius and the certain period H1 is two hours.

As apparent from the solid lines in FIG. 10, where the fixing backup roller 27 is in the waiting state, or namely, in a state that the fixing motor 28 is not operated to rotate only in the prescribed amount, the deformation amounts of the surface of the fixing backup roller 27 increases according to increase of the inactivated time. The deformation amounts of the surface of the fixing backup roller 27 becomes less as the waiting temperature T2 is lower.

As apparent from the broken line in FIG. 10, where the fixing motor 28 is operated to rotate only in the prescribed amount at each of the certain period H1, the deformation amounts of the surface of the fixing backup roller 27 may not be changed because the surfaces of the fixing roller 26 and the fixing backup roller 27 move in the circumferential direction in the moving amount equal to or less than the nip width B at every two hours.

It is to be noted that if the type of the recording paper 61 is the medium b, the deformation amounts of the surface of the fixing backup roller 27 becomes substantially the same as that of the medium a, even where the certain period H1 set by the primary rotation time setting section 30*f* is longer than that of the medium a, because the waiting temperature T2 is lower than that of the medium a. If the type of the recording paper 61 is the medium c, the deformation amounts of the surface of the fixing backup roller 27 becomes substantially the same as that of the medium a, even where the certain period H1 set by the primary rotation time setting section 30*f* is further longer than that of the medium a, because the waiting temperature T2 is further lower than that of the medium a.

Thus, by changing the certain period H1 set by the primary rotation time setting section 30*f* in accordance with the waiting temperature T2 set by the waiting temperature setting section 30*d*, the fixing motor 28 is not required to rotate excessively, thereby reducing the power consumption and occurrence number of operation noises.

Next, operation in a case that the waiting time H is set by the waiting time setting section 30*c* is described.

In this embodiment, the waiting time setting section 30*c* can set any time as the waiting time H. The waiting time setting section 30*c* can set to maintain the waiting temperature T2 always where the main power of the image forming apparatus 10 is turned on. In a case of the setting mentioned above, the fixing motor 28 is operated to rotate in the prescribed amount at each of the certain period H1 according to the setting shown in FIG. 9 as far as not receiving any printing instruction from the host apparatus.

To the contrary, in a case where the waiting time H set by the waiting time setting section 30*c* is five hours, and where the setting is chosen as the setting corresponding to the medium a shown in FIG. 9, the image forming controller 30 rotates the fixing motor 28 in a prescribed amount after two hours later and four hours later from entering the waiting state because the certain period H1 set by the primary rotation time setting section 30*f* is two hours, thereby moving the surfaces of the fixing roller 26 and the fixing backup roller 27 in the circumferential direction only in the moving amount equal to or less than the nip width B. Subsequently, when reaching the waiting time H or five hours, the image forming controller 30 again rotates the fixing motor 28 in a prescribed amount immediately before entering the power saving mode in which the heater 38 is controlled to be turned off, thereby moving the surfaces of the fixing roller 26 and the fixing backup roller 27 in the circumferential direction only in the moving amount equal to or less than the nip width B.

Where entering in the power saving mode, because the heater 38 is controlled to be turned off, the temperature of the fixing device 25 detected with the thermistor 34 is lowered to the room temperature as far as not receiving any printing instruction from the host apparatus. The image forming controller 30 stops operation to rotate the fixing motor 28 in the prescribed amount at the same time as making a transition to the power saving mode.

With this embodiment, in a case where the waiting time H is set by the waiting time setting section 30*c*, the fixing motor 28 is operated to rotate in the prescribed amount immediately before making a transition to the power saving mode where the waiting time H is passed after entering the waiting state regardless any setting shown in FIG. 9. The fixing device therefore can prevent any nip scar from occurring because the surfaces of the fixing roller 26 and the fixing backup roller 27 are moved in the circumferential direction only in the moving amount equal to or less than the nip width B immediately before the transition to the power saving mode, even though the fixing device 25 makes the transition to the power saving mode at which the temperature of the fixing device 25 is made lower.

It is to be noted that in the embodiment, the situation that the types of the recording paper 61 set by the printing medium setting section 30*a* are the three types of the medium a, the medium b, and the medium c, is described, but the types of the recording paper 61 are not limited to this, and the printing medium setting section 30*a* can set any type of the recording paper 61. Although the fixing device 25 is described as including the fixing backup roller 27 and the fixing roller having the heater 38 inside, the fixing device 25 may have a planar heater, a fixing belt, and a pressing roller, and a nip portion 58 may be formed on a surface of the pressing roller. Although the black color K motor 48K, the yellow color Y motor 48Y, the magenta color M motor 48M, and the cyan color C motor 48C are formed independently to rotate the respective portions in the image forming units 12K, 12Y, 12M, 12C, a drive unit or units to rotate the respective portions in the image forming units 12K, 12Y, 12M, 12C are not limited to those, and for example, one motor can rotate the respective portions in the image forming units 12K, 12Y, 12M, 12C. Although in this embodiment the image forming apparatus 10 has the image forming units 12K, 12Y, 12M, 12C corresponding to the four colors, the image forming apparatus 10 can have a single image forming unit 12 corresponding to only monochrome such as, e.g., black. Although the exposing device is described as the LED head 13 in this embodiment, the exposing device may be a laser exposure unit including a laser generator and a polygon mirror. Although in the embodiment, the image forming apparatus 10 is a type directly transferring the toner images to the recording paper 61, the toner images may be transferred to the recording paper 61 indirectly via an intermediate transfer belt.

With this embodiment, the image forming apparatus 10 can move the surfaces of the fixing roller 26 and the fixing backup roller 27 in the circumferential direction only in the moving amount equal to or less than the nip width B by rotating the fixing motor 28 only in the prescribed amount at each time passing the certain period H1 set by the primary rotation time setting section 30*f* during the waiting state. The image forming apparatus 10 therefore can prevent the surface of the fixing backup roller 27 from deforming, thereby preventing abnormal noises due to deformation from occurring and preventing rotational loads from increasing.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A fixing device, comprising:

a heating member;

a fixing member heated from the heating member; and a pressing member in pressurized contact with the fixing member, the pressing member formed with a contact portion either at the fixing member or at the pressing member, wherein the fixing member and the pressing member are driven only in an amount equal to or less than a width of the contact portion at every time when a certain period elapses, during a waiting state in which the fixing member and the pressing member are stopped from being driven and in which the heating member is heating the fixing member, and wherein the heating member is subject to plural settings of the heating temperature during the waiting state and wherein the certain period is changed in accordance with the settings of the heating temperature.

2. The fixing device according to claim 1, wherein the certain period becomes longer as the setting of the heating temperature is lower.

3. The fixing device according to claim 1, wherein the heating temperature is set in accordance with types of a medium as the object of a fixing process.

4. The fixing device according to claim 1, wherein the fixing device enters into a power saving state after the fixing member and the pressing member are driven only in an amount equal to or less than the width of the contact portion, where the fixing device shifts from the waiting state to the power saving state in which the fixing member and the pressing member are stopped from being driven while the heating member is stopped from heating.

5. An image forming apparatus comprising:

the fixing device according to claim 1; and a fixing device controller for controlling the fixing device.

6. An image forming apparatus comprising:

a heating member;

a fixing member heated from the heating member;

a pressing member contacted with the fixing member, a fixing controller for rotating the fixing member and the pressing member, wherein a contact portion is formed where the fixing member contacts the pressing member, wherein the fixing controller stops rotating the fixing member and the pressing member, and after stopping the rotating, the fixing controller determines that a certain period has elapsed and rotates the fixing member and the pressing member only in an amount equal to or less than a width of the contact portion when the certain period elapses.

7. The image forming apparatus according to claim 6, wherein a heating by the heating member is performed in accordance with a waiting target temperature during a waiting state such that the rotation of the fixing member and the pressing member is stopped by the fixing controller, wherein the heating by the heating member to the fixing member is subject to plural settings of the waiting target temperature and wherein the certain period is set in accordance with the setting of the waiting target temperature.

8. The image forming apparatus according to claim 7, wherein the certain period becomes longer as the setting of the waiting target temperature is lower.

9. The image forming apparatus according to claim 8, wherein the waiting target temperature is set in accordance with the kind of the recording medium.

10. The image forming apparatus according to claim 7, wherein a heating target temperature in which the toner images are allowed to fix to the recording medium is set to be higher than the waiting target temperature, and wherein a rotating starting target temperature in which the fixing member and the pressing member are allowed to start to rotate is set to be lower than the waiting target temperature.

11. The image forming apparatus according to claim 6, the apparatus enters into a power saving state after the fixing member and the pressing member are rotated only in the amount equal or less than the length of the contact portion, where the apparatus shifts from the waiting state in which the fixing member and the pressing member are stopped from rotating to the power saving state in which the heating member is stopped from heating.

12. The image forming apparatus according to claim 11, wherein the fixing member and the pressing member are rotated each time the certain period elapses during the waiting state, and wherein a rotation of the fixing member and the pressing member is stopped during the power saving state after entering the power saving state.

* * * * *